United States Patent [19]

Battershill

[11] 4,282,616

[45] Aug. 11, 1981

[54] RIGID COLLAPSIBLE BOAT

[76] Inventor: Ronald Battershill, 4248 Palo Verde, Lakewood, Calif. 90713

[21] Appl. No.: 41,549

[22] Filed: May 23, 1979

[51] Int. Cl.[3] ..... B63B 7/00

[52] U.S. Cl. ..... 9/2 C

[58] Field of Search ..... 9/2 R, 2 A, 2 C, 2 F, 9/2 S, 6.5, 7; 114/77 R, 77 A

[56] References Cited

U.S. PATENT DOCUMENTS

| | | | |
|---|---|---|---|
| 2,577,970 | 12/1951 | Larsson et al. | 9/2 C |
| 3,108,295 | 10/1963 | Schor et al. | 9/2 C |
| 3,124,813 | 3/1964 | Graef | 9/6 P |

FOREIGN PATENT DOCUMENTS

| | | | |
|---|---|---|---|
| 516835 | 1/1940 | United Kingdom | 9/2 F |

*Primary Examiner*—Trygve M. Blix
*Assistant Examiner*—Jesüs D. Sotelo
*Attorney, Agent, or Firm*—Fulwider, Patton, Rieber, Lee & Utecht

[57] ABSTRACT

A rigid collapsible boat has a plurality of rigid hull sections hinged together along mating, longitudinally extending edges throughout the hull length. The joints are hinged with flexible nylon cord and are sealed watertight by sealing strips that extend longitudinally along the hinged edges. A flexible, watertight stern panel is fastened across the stern ends of the hull sections. A stern thwart, with a transom reinforcing back, a midthwart, extending across the beam of the boat, and a bow thwart provide rigid support to the boat. The hull sections and thwarts are all fastened together by means of flexible nylon cord that is laced through apertures in the thwarts and in the hull sections.

6 Claims, 10 Drawing Figures

FIG. 1
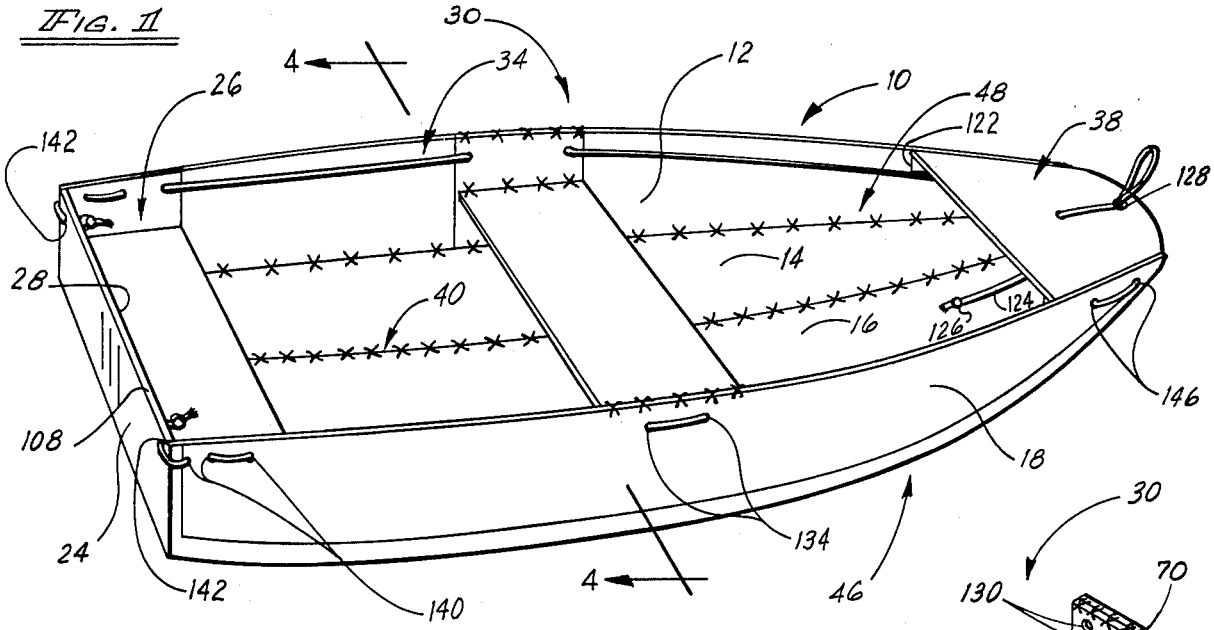
FIG. 3
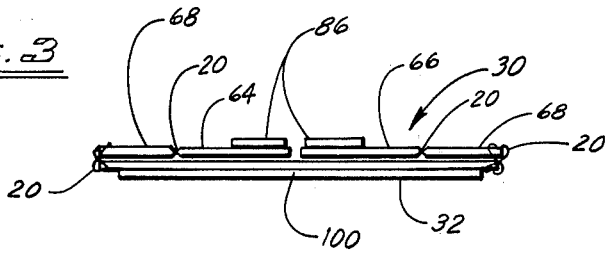
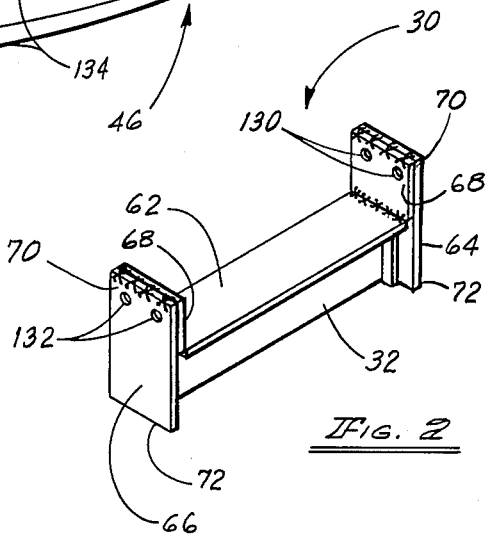
FIG. 2
FIG. 10
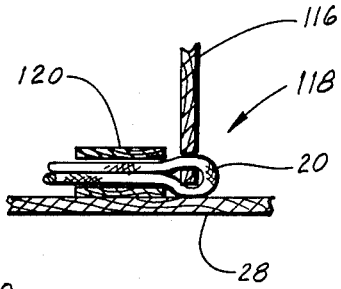
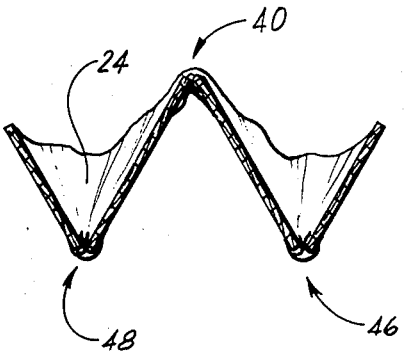
FIG. 4
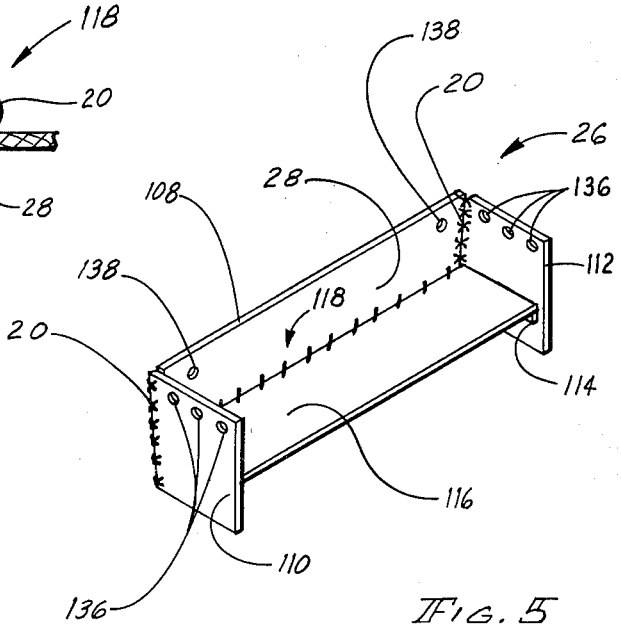
FIG. 5

RIGID COLLAPSIBLE BOAT

BACKGROUND OF THE INVENTION

1. Field of the Invention

The present invention relates to collapsible boats, for use as dinghies, shore boats, fishing boats or other light water navigation.

2. Description of the Prior Art

In the past, various types of collapsible boats have been devised which can be conveniently stored and carried compactly and reassembled at the location at which they are to be used. Many of such boats currently in use are inflatible and are formed of a flexible material, such as rubber, rubberized canvas and the like. However, such flexible, inflatable boats have several distinct disadvantages. While they can be collapsed for compact storage, they require a considerable time and effort for inflation at the site at which they are to be used. Typically, foot pumps are necessary accessories for such inflatable boats, but even with a foot pump, considerable time and a great deal of effort is required to inflate such a boat for use. Furthermore, flexible hulled boats exhibit a tremendous drag in the water. For this reason some such boats have been provided with wooden floor boards, but this complicates storage and transport considerably. Flexible hulled boats are extremely difficult to row or paddle, because of the drag in the water which they create while moving. For the same reason, they require oversized motors for their use.

Flexible hulled boats also typically exhibit a great deal of area of exposure to the wind, and are difficult to propel against the wind. Furthermore, a person entering or seated in a flexible hulled boat will produce a considerable indentation in the boat profile, so that any water present or splashing over the sides of the boat will immediately flow with gravity toward the body of a person in the boat, to that person's discomfort.

Various types of rigid hulled, collapsible boats have also been devised but all have involved very distinct problems. Conventional collapsible, rigid hulled boats have hull floors which tend to buckle from the subsurface pressure of the water beneath while they are in use. Moreover, such boats require numerous parts and their assembly at a launch site for use is quite time consuming and intricate. Furthermore, all conventional collapsible, rigid hulled boats require at least a minimal amount of exposed metal in their construction. When used in marine or fresh water environments, this metal quickly rusts, detracting from the appearance of the boat, and also from its structural integrity.

SUMMARY OF THE INVENTION

The present invention is a collapsible boat formed with a plurality of rigid hull sections hinged together along edges which extend longitudinally throughout the hull length. The hull sections are laced together by means of flexible cord, typically nylon line such as is commonly used with sail boats and other pleasure craft. The hull sections are laced together with this flexible line, and the joints are rendered waterproof by watertight sealing strips that extend along the length of the boat at the hinged, hull section joints. At the stern of the hull sections, a flexible, watertight stern panel is provided that is fastened to the stern ends of the hull sections in watertight engagement. A stern thwart, equipped with a transom reinforcing back is positioned against the flexible stern panel that is permanently attached to the hull sections. Likewise, a midthwart having an upright panel for positioning in contact with the hull floor sections, and a seat thereabove, is positioned across the width of the boat at approximately the beam thereof. Both the upright midthwart panel and the midthwart side braces bear downward upon the floor sections of the hull. A bow thwart is mounted at the prow of the boat where the hull sections curve upwardly. The hull sections and the thwarts are all laced together, through mating apertures in the component pieces, by means of a flexible line, such as a ½ inch thick braided nylon line.

The boat of the invention has distinct advantages in that both the hull and the thwarts can be dismantled and folded down substantially flat. The boat can be launched virtually anywhere and requires no special tools for reassembly. The boat requires no special storage, no towing, nor must it be launched from any ramp. The entire boat, including all of the thwarts weighs only about 80 pounds.

The portable boat of the invention may be assembled by a single person in about 10 minutes, and requires no laborious inflation. The boat has a solid bottom which reduces drag in the water. As a consequence, the boat may be sailed or rowed, and it can be powered easily with a low horsepower motor, such as a 1.2 horsepower outboard motor.

The boat requires no metal parts, so that there is absolutely no metallic corrosion in the boat structure. The boat is preferably constructed of plywood, so that it will not sink, even if virtually filled with water. The ½ inch line with which the boat thwarts are laced to the hull sections extends fore and aft around the boat, and provides easy comfortable handles for carrying the boat to or from a launching site.

The invention may be described with greater clarity and particularly by reference to the accompanying drawings.

DESCRIPTION OF THE DRAWINGS

FIG. 1 is a perspective view of the boat of the invention assembled.

FIG. 2 is a perspective view of the midthwart assembly in isolation.

FIG. 3 is a front view of the midthwart assembly in a collapsed condition.

FIG. 4 is a sectional view taken along the lines 4—4 of FIG. 1 with the stern thwart removed and with the hull partially collapsed.

FIG. 5 is a perspective view of the stern thwart assembly.

FIG. 10 is a detail section of one of the stern thwart assembly joints.

DESCRIPTION OF THE EMBODIMENT

Figure 6:
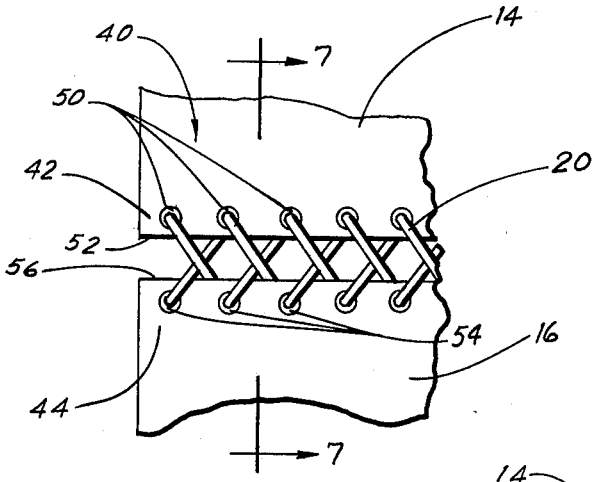
FIG. 6 is a detail view of a portion of a joint between hull sections.

FIG. 1 shows a collapsible boat 10, about 8 feet in length overall, and constructed according to the invention and including four elongated longitudinally joined hull sections, including a port side panel 12, a port bottom panel 14, a starboard bottom panel 16, and a starboard side panel 18. These hull panels are hinged together along their adjacent edges which extend longitudinally throughout the hull length, and which are laced to each other by means of a flexible cord 20, laced through mating apertures in adjacent panels in the manner depicted in detail in FIG. 6. The joints are sealed by flexible, watertight sealing strips 22 that extend along the hinged edges of the hull panels, and which are illustrated in detail in FIG. 7. A flexible, generally trapezoidal shaped watertight stern panel 24 is fastened to the stern ends of the hull panels 12–18 in watertight engagement therewith. A stern thwart assembly 26 is equipped with an upright transverse trapezoidal shaped transom reinforcing back 28, depicted in FIG. 5, for positioning against the flexible stern panel 24 as illustrated in FIG. 1. A midthwart assembly 30 is depicted in isolation in FIG. 2 and has an upright panel 32 for positioning in contact with the hull bottom section panels 14 and 16. A flexible nylon cord or line 34 is threaded through mating apertures in the port and starboard side panels 12 and 18 and through corresponding apertures in the stern thwart assembly 26, the midthwart assembly 30, a bow thwart assembly 38, shaped generally as a truncated pyramid and positioned laterally across the prow of the boat 10 between the bow extremities of the port side panel 12 and the starboard side panel 18.

Figure 7:
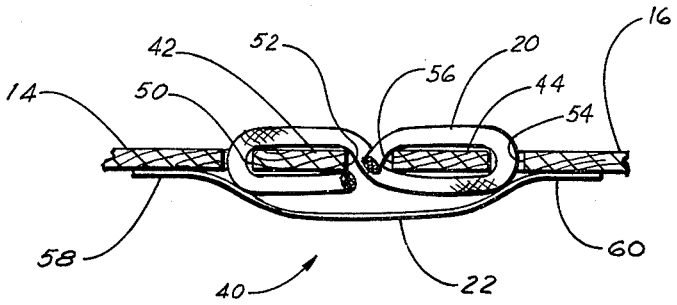
FIG. 7 is a detail view taken along the lines 7—7 of FIG. 6.

The port and starboard bottom panels 14 and 16 are joined together along a linear, fore and aft keel joint 40 by means of 3/16 inch diameter nylon line 20 in the manner depicted in FIGS. 6 and 7. The port and starboard bottom panels 14 and 16 meet in generally straight, linear edges 42 and 44, as depicted in FIG. 6 along the keel junction 40 of the boat 10. The outer edge contours of the hull bottom panels 14 and 16 are mirror images of each other, and curve inwardly from a broadest width at the beam of the boat 10, just to the rear of the midthwart section 30 in gentle arcs toward the stern of the boat 10. Similarly, at the bow of the boat the curvature of the outer edges of the bottom panels 14 and 16 is likewise gentle, but more pronouced than at the stern of the boat.

The port side panel 12 and starboard side panel 18 are joined, respectively, to the port bottom panel 14 and starboard bottom panel 16 along edges which are curved in mirror image to the edges of the bottom panels with which they are joined. The pronounced curvature at the bow of the boat ensures that the bow rides up and out of the water, thus reducing drag by preventing the boat from plowing through the water. The outside edge of the starboard bottom panel 16 is joined to the side panel 18 in a starboard chine junction 46 while the port bottom panel 14 is joined to the port side panel 12 in a corresponding left chine junction 48.

The joints between the side and bottom panels 12–18 are all constructed in essentially the same fashion, as illustrated in association with the keel joint 40 in FIG. 6. At the keel junction 40, the interior edge 42 of the port bottom panel 14 is perforated by a linear series of spaced apertures 50, slightly inward from the exposed face 52 of the edge 42 of the port bottom panel 14. Similarly, the edge 44 of the starboard bottom panel 16 is perforated by a longitudinal series of corresponding mating apertures 54 spaced slightly inwardly of the abutting face 56 of the edge 44. A 3/16th inch diameter nylon cord 20 is laced through the apertures 50 and 54 in the abutting edges 42 and 44 of the port and starboard bottom panels 14 and 16 in cross-over fashion as depicted in FIGS. 6 and 7. The cord 20 passes between the adjacent edges 42 and 44 of the bottom panel sections 14 and 16, respectively from apertures on one hull section to apertures on the other hull section hinged thereto. By lacing the cord 20 in shoelace fashion as illustrated, the abutting faces 52 and 56 of the edges 42 and 44 cannot grind against each other, or inadvertently snag and tear the sealing strip 22 located therebelow (FIG. 7). Rather, the abutting faces 52 and 56 are separated from each other by at least the 3/16th inch thickness of the line 20.

The cord 20 is sufficiently strong so that it is not sheared by opposing longitudinal or lateral forces on the port and starboard bottom panels 14 and 16. Rather, the bottom panels 14 and 16 are held rigidly in place together when the stern thwart assembly 26, the midthwart assembly 30 and the bow thwart 38 are laced into position in the manner depicted in FIG. 1.

At the underside of the keel joint 40 a strip 22 of rubberized, elastomeric, waterproof fabric extends the length of the joint 40 between the bottom panels 14 and 16, and is glued to the undersides of the edges 42 and 44 at the peripheral edges 58 and 60 of the strip 22, as depicted in FIG. 7. One suitable fabric construction is available under the tradename Hyperlon. The edges 42 and 44 of the bottom panels 14 and 16 are thereby joined in a watertight, sealed fashion at the keel joint 40.

The starboard and port chine joints 46 and 48, respectively, are constructed in essentially the same fashion depicted in FIGS. 6 and 7, but it is to be understood that unlike the bottom panels 14 and 16, the side panels 12 and 18 form essentially right angles with the bottom panels to which they are joined. Nevertheless, the lacing of the line 20 and sealing mechanism of the longitudinal strip 22 is the same as is used to join the bottom panels 14 and 16 in the manner depicted in FIGS. 6 and 7.

While the chine joints 46 and 48 and the keel joint 40 of the hull of the boat 10 hold the hull panels 12–18 longitudinally and laterally immobile relative to each other, the hull panels 12–18 are joined to each other in hinged fashion, as illustrated in FIG. 4. That is, with the thwart assemblies removed, the hull of the boat 10 can be collapsed in an accordion, or "W" shaped fashion into a flat, compact arrangement. When collapsed in this manner, the flexible stern panel 24 hangs loosely, but still in tightly sealed engagement with the transverse stern edges of the hull section panels 12–18. The flexible stern panel 24, like the sealing strips 22, is formed of a rubberized, elastomeric fabric.

Figure 8:
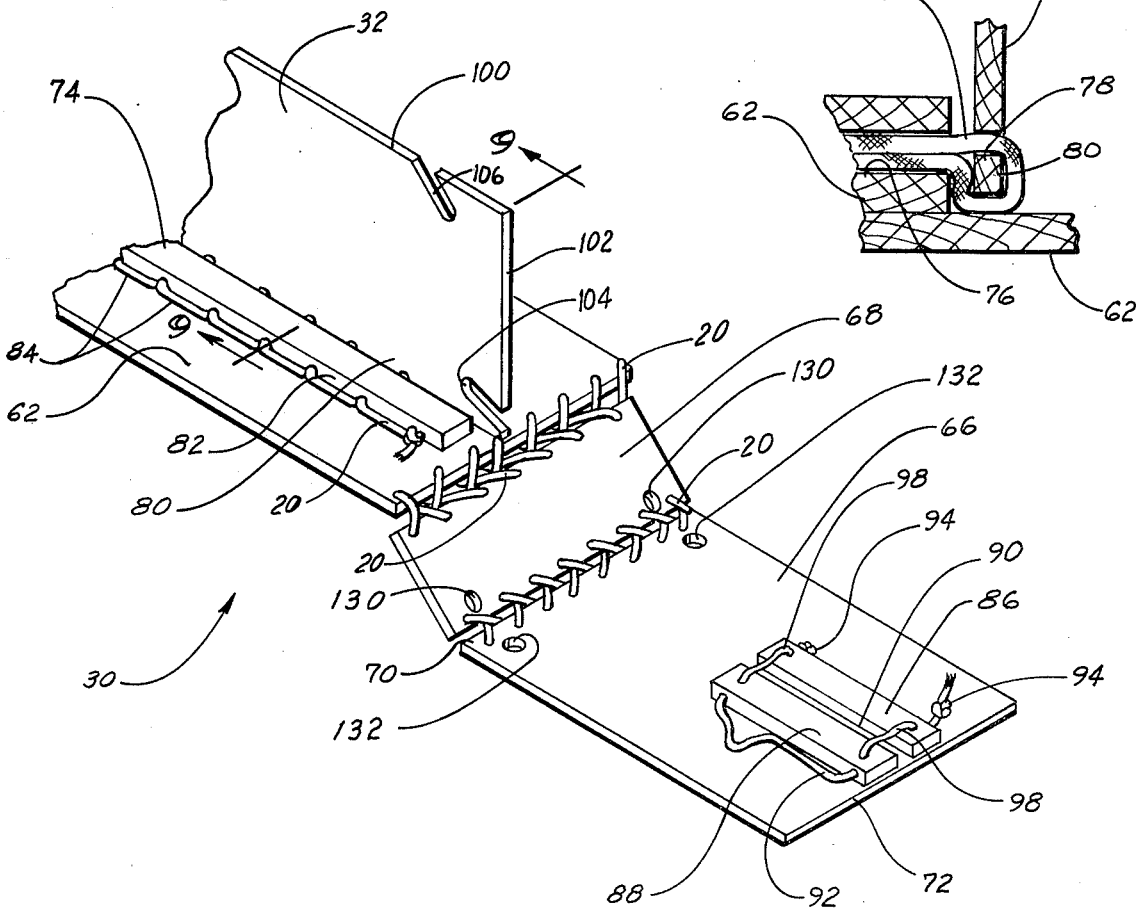
FIG. 8 is a detail view showing the construction of the underside of the midthwart assembly.
Figure 9:
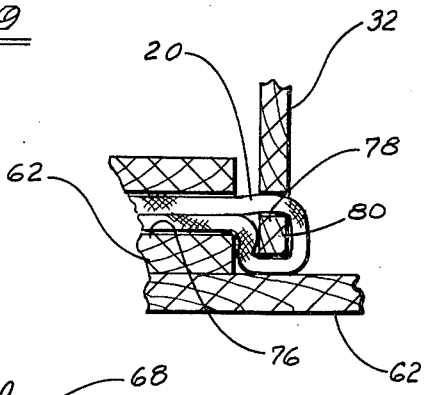
FIG. 9 is a detail section taken along the lines 9—9 of FIG. 8.

The midthwart assembly 30 is depicted in detail in FIGS. 2, 3 and 8. The midthwart assembly 30 is constructed with a generally flat, rectangular, horizontally disposed transverse seat 62 joined to opposing generally upright rectangular shaped side braces 64 and 66 by means of spacer panels 68 hinged to the upper edge extremities 70 of the side braces 64 and 66. The seat 62 is thereby carried at a level between the vertical upper edges 70, and lower edges 72 of the side braces 64 and 66. The upright panel 32 is a seat support and is hingedly joined to the underside of the transverse seat 62 in the manner depicted in FIGS. 8 and 9.

An elongated transverse mounting block 74 is glued to the underside of the seat 62 as illustrated in FIG. 8. The mounting block 74 has a series of spaced fore and aft apertures 76 drilled therethrough, illustrated in FIG. 9. The upright seat support 32 has a corresponding series of apertures 78 drilled therethrough near its transversely extending edge 80 located proximate to the underside of the seat 62. A single length of 3/16 inch nylon cord 20 is threaded through each aperture 76, around the edge 80 of the seat support 32 in a loop, back through the aperture 78 in the upright seat support 32, and back through the same aperture 76, in the manner depicted in FIGS. 8 and 9. In this fashion, the cord 20 is directed back and forth through each of the apertures 76 and thence to the next aperture in transverse links 84 along the exposed edge 82 of the transverse support block 74.

Spacers panels 68 are attached in hinged fashion to the ends of the seat 62 through apertures therein by means of cord 20 laced in the same fashion as depicted in FIGS. 6 and 7, previously described in association with the hull construction of the boat 10. Cord 20 is similarly laced through opposing apertures through the upper edges 70 of the side braces 64 and 66, and through corresponding mating apertures in the spacer panels 68. This lacing likewise is depicted in FIG. 8, and is described in detail in association with the lacing arrangement of FIGS. 6 and 7.

The side braces 64 and 66 include elongated alignment blocks 86 and 88, which lie in upright disposition when the midthwart assembly 30 is installed in position in the boat 10. The alignment blocks 86 and 88 are spaced from each other by a gap which defines a slot 90 between facing surfaces of each of the side braces 64 and 66. Downwardly and outwardly directed holes are drilled in the expansive exposed surfaces of the support blocks 86 and 88 to receive latch lines 92, in the manner depicted in FIG. 8. The latch lines 92 are knotted at 94 at both ends, and pass across the exposed surfaces of the alignment blocks 86 and 88 in latch loops 98 at either end of the alignment blocks 86 and 88. The latch lines 82 may be moved lengthwise through the apertures in the alignment blocks 86 and 88 to lengthen or shorten the latch loops 98.

The upright seat support 32 has a long transverse edge 100 which extends across the width of the boat 10 in contact with the hull bottom panels 14 and 16. At the ends of the seat support panel 32 there are upright edges 102 which are designed to fit into the slots 90 between the alignment blocks 86 and 88. The ends 102 of the upright seat support panel 32 include slots 104 which slant downwardly and inwardly toward the bottom edge 100. The bottom edge 100 includes slots 106 close to the ends 102 thereof, which are slanted upwardly toward the ends 102.

To assemble the midthwart assembly 30, the upright seat support panel 32 is positioned essentially perpendicular to the underside of the seat 62 as illustrated in FIG. 8. The spacer panels 68 are then rotated away from the ends 102 and the side braces 64 and 66 are brought toward the ends 102 of the upright support panel 32. The spacer panels 68 and the upper portions of the side braces 64 and 66 are then parallel in face to face contact. The loops 98 of the latch lines 92 closest to the spacer panels 68 are inserted into the slots 104 as the ends 102 are guided into the gap 90 between the spacer blocks 86 and 88. These loops are tightened to allow sufficient line to lengthen the opposite loops 98 near the bottom edges 72 of the side panels 64 and 66. These loops are then slipped over the extremities of the edges 100 of the seat support panel 32 and into the slots 106. The latch lines 92 are then pulled tight and the midthwart assembly 30 assumes the configuration depicted in FIG. 2 and is ready for installation into the hull of the boat 10. It should be noted that all of the hinged joints of the midthwart 30 are formed by flexible cord 20 laced through mating apertures in the joined parts.

To disassemble the midthwart assembly 30, the opposite procedure is repeated to disengage the edges 102 of the seat support panel 32 from the gaps 90. Thereafter, the seat support panel 32 is folded flat against the underside of the seat 62, and the spacer panels 68 and side braces 64 and 66 are folded flat over the seating surfaces of the seat 62 in the manner depicted in FIG. 3. The midthwart 30 can thereby be folded into the flat configuration of FIG. 3 for ease of transport.

The stern thwart assembly is depicted in isolation in FIG. 5, ready for installation into the hull of the boat 10. The stern thwart assembly 26 includes a unitary transom reinforcing back 28, generally of trapezoidal shape with a smaller base directed downward against the stern edges of the bottom panels 14 and 16 of the boat hull, and with the longer base edge 108 directed upwardly. The stern thwart includes generally rectangular forwardly directed side braces 110 and 112 joined to either side of the back panel 28 by cord 20 in the same manner depicted in FIGS. 6 and 7 in association with a joint between the hull panels. Longitudinal bearing supports 114, extend along the mutually facing surfaces of the side braces 110 and 112, and a seat panel 116 is hingedly joined at a joint 118 across the transom reinforcing back 28, in the manner depicted in detail in FIG. 10.

The seat 116 is supported upon the bearing supports 114 along its outer edges, and along its back edge by a support block 120. The structured detail of the joint 118, using nylon cord 20, is depicted in detail in FIG. 10 and is of the same configuration used to attach the upright seat support panel 32 to the underside of the seat 62 in the midthwart assembly 30, as described in conjunction with FIGS. 8 and 9.

All of the hinged joints of the stern thwart assembly 26 are formed by flexible line 20 laced through mating apertures in the joined parts, and the stern thwart assembly 26 folds into a relatively flat package, as does the midthwart assembly 30, depicted in FIG. 3.

The boat 10 also includes a bow thwart 38. The bow thwart 38 is generally triangular shaped, with a rounded apex and fits into the confines of opposing edges of the upper, forward edges of the port side panel 12 and starboard side panel 18. The bow thwart 38 includes downwardly turned ears 122, running along both its port and starboard sides which are glued to the underside of the flat, tranverse bow thwart 38. The bow thwart 38 is equipped with an aperture through which a painter 124 is threaded. The painter 124 can be pulled either way through the aperture in the bow thwart 38 to the extent allowed by knots 126 and 128 in the opposite ends thereof. The painter 124 can thereby be pulled almost entirely within the boat so that it does not trail in the water as the boat moves. Alternatively, when it is desired to land the boat, the painter can be pulled out full length so that the knot 126 bears against the underside of the thwart 38 and the painter 128 can be used as a dock line or otherwise for landing.

All of the thwart assemblies include apertures through which the lacing line 34 (FIG. 1) is strung. The midthwart 30 includes apertures 130 in the spacer panels 68 and apertures 132 near the upper edges 70 of the side braces 64 and 66. The apertures 130 and 132 are in registration with each other when the midthwart assembly 30 is assembled as in FIG. 2. These apertures are likewise in registration with corresponding apertures 134 in the port and side panels 12 and 18, depicted in FIG. 1. Similarly, apertures 136 are provided in the side braces 110 and 112 of the stern thwart assembly 26, and apertures 138 are provided in the transom reinforcing back 28 of the stern thwart assembly 26. Corresponding apertures 140 are provided in the port and starboard side panels 12 and 18 for registration with the apertures 136, and apertures 142 are provided in the flexible stern panel 24 for registration with the apertures 138 in the stern thwart assembly 36.

With the thwart assemblies in position as depicted in FIG. 1, the lacing line 34, with a knot in one end is first threaded from the inside through one of the apertures 138 in the transom reinforcing back 28 of the stern thwart assembly 26. The line is passed through the corresponding aperture 142 in the flexible stern panel 124, and laced through the apertures 140 and 136 along one side of the boat 10 in the manner depicted in FIG. 1. The line 34 then passes along the inside of either the port or starboard side panel 12 or 18 and thence through aligned apertures 130, 132 and 134 at the midthwart assembly 30 in the manner depicted in FIG. 1. The line is passed forwardly through mating apertures in the ears 122 of the bow thwart assembly and corresponding apertures 146 in the side panels 12 and 18. The lacing line 34 is then passed to the opposite side of the boat and laced from bow to stern in the opposite direction. Once inside the stern thwart assembly 26 through the apertures 138, it is knotted, and the boat is ready for use.

It can be seen that the exposed sections of lacing line 34 between the apertures 140, the apertures 134, and the apertures 146 on the outside of the hull side panels 12 and 18 form convenient hand holds for use in carrying the boat to and from a desired launching site. The transom reinforcing back 28 of the stern thwart assembly 26 is of sufficient strength to allow a motor to be mounted thereon. If desired, the bow thwart 38 can be equipped with a mast restraining means, and the boat can be sailed. In the preferred embodiment, a gaff rigged mast assembly is provided to reduce the overall length of a mast from about 16 feet, normally used with an eight foot boat of the type depicted in FIG. 1, to two eight foot sections. This facilitates transport and storage of the mast. Also, lee boards can be provided with apertures for registration with the apertures 134 in the port or side panel 12 or 18 and can be laced into position by the lacing line 34 during assembly of the boat.

All of the hull panels 12–18 are preferably formed of $\frac{1}{2}$ inch plywood. Likewise, in the stern thwart assembly 26, the transom reinforcing back 28, side braces 110 and 112 and seat 116 are also formed of $\frac{1}{2}$ inch plywood. The seat 62 of the midthwart assembly 30 is also formed of $\frac{1}{2}$ inch plywood, but the side braces 64 and 66, the spacer panels 68, and the seat support 32 are preferably formed of $\frac{1}{4}$ inch plywood.

The boat 10 is constructed without any metal whatsoever. This avoids corrosion and preserves its appearance. The lacing line 34 acts as shearpins where it passes through mating apertures in the thwart assemblies and the hull of the boat, and is sufficiently stout to hold the boat 10 tightly in the geometry depicted in FIG. 1. The lower ends 72 of the midthwart side braces 65 and 66, along with the lower edge 100 of the seat support panel 32 bear downwardly against the bottom hull panels 14 and 16 to force the boat to hold its shape, and to prevent the pressure of water beneath from buckling the boat in the manner depicted in FIG. 4 when the midthwart assembly 30 is laced in place. The lower edges of the back panel 28 and side braces 110 and 112 of the stern thwart assembly 26 also aid in this same function.

While but a single embodiment of the boat of the invention has been depicted in the drawings, it should be understood that numerous variations and modifications of a boat constructed according to the invention are possible. Accordingly, the scope of the present invention should not be limited to the specific embodiment depicted, but rather is defined in the claims appended hereto.

I claim:

1. A collapsible boat comprising:

a plurality of rigid hull sections hinged together along edges which meet in mating curves to form a hull prow and which extend longitudinally throughout the hull length and which are hinged together by means of flexible cord laced through mating apertures therein, flexible, water tight sealing strips that extend along said hinged edges, a flexible water tight stern panel that is fastened to stern ends of said hull sections in watertight engagement therewith, a stern thwart having a transom reinforcing back for positioning against said flexible stern panel, a midthwart having an upright panel for positioning in contact with said hull sections, a bow thwart extending across bow ends of said hull sections, and a single length of flexible cord that passes along one side of said hull to the other, laced to hold said stern thwart, said midthwart, and said bow thwart to said hull sections.

2. A collapsible boat according to claim 1 further characterized in that said bow thwart includes an aperture and a painter is provided extending through said bow thwart aperture, and longitudinally adjustable relative thereto.

3. A collapsible boat according to claim 1 further characterized in that said stern thwart includes a unitary back, forwardly directed side braces hingedly joined to either side of said back, longitudinally bearing supports extending forwardly along the inside surfaces of said side braces, and a seat panel, hingedly joined laterally across said back and supportable upon said bearing supports, and all of said hinged joints of said stern thwart are formed by flexible line laced through mating apertures in said joined parts.

4. A collapsible boat comprising:

a plurality of rigid hull sections hinged together along edges which extend longitudinally throughout the hull length and which are hinged together by means of flexible cord laced through mating apertures therein, flexible, watertight, sealing strips that extend along said hinged edges, a flexible watertight stern panel that is fastened to stern ends of said hull sections in watertight engagement therewith, a stern thwart having a transom reinforcing back for positioning against said flexible stern panel, and a midthwart having an upright panel for positioning in contact with said hull sections, opposing side braces at either end of said upright panel, spacer panels hinged to the upper extremities of said side braces, a transverse seat hingedly joined to said spacer panels so that said transverse seat resides at a level between the vertical extremities of said side braces, an upright seat support hingedly joined to the underside of said transverse seat, upright alignment blocks defining slots therebetween on said side braces for receiving and immobilizing the ends of said upright seat support, and all of said hinged joints of said midthwart are formed by flexible cord laced through mating apertures in the joined parts thereof.

5. A collapsible boat according to claim 4 further characterized in that said ends of said upright seat support include slots slanting downwardly and inwardly toward the bottom edge of said seat support, and said bottom edge of said seat support includes slots proximate the ends thereof slanted upwardly toward said ends, and lengths of flexible latch line with knotted ends are disposed to extend through spaced apertures in said alignment blocks and are longitudinally adjustable therein, whereby said latch line is securable in said slots to hold said ends of said upright seat support in registration in said slots.

6. A collapsible boat according to claim 4 further characterized in that said flexible cord is laced through said mating apertures in said hull sections in cross over fashion passing between the adjacent edges of said hull sections from apertures on one hull section to apertures on another hull section hinged thereto.

* * * * *